US005973651A

United States Patent [19]

Suesada et al.

[11] Patent Number: 5,973,651

[45] Date of Patent: Oct. 26, 1999

[54] CHIP ANTENNA AND ANTENNA DEVICE

[75] Inventors: Tsuyoshi Suesada, Omihachiman; Seiji Kanba, Otsu; Teruhisa Tsuru, Kameoka, all of Japan

[73] Assignee: Murata Manufacturing Co., Ltd., Japan

[21] Appl. No.: 08/931,612

[22] Filed: Sep. 16, 1997

[30] Foreign Application Priority Data

Sep. 20, 1996 [JP] Japan ..... 8-250142

[51] Int. Cl.[6] ..... H01Q 9/00

[52] U.S. Cl. ..... 343/752; 343/895; 343/702

[58] Field of Search ..... 343/752, 702, 343/700 MS, 749, 873, 713, 715, 895; H01Q 9/00

[56] References Cited

U.S. PATENT DOCUMENTS 5,696,517 12/1997 Kawahata et al. ..... 343/873

5,760,746 6/1998 Kawahata ..... 343/702

5,767,811 6/1998 Mandai et al. ..... 343/702

*Primary Examiner*—Don Wong

*Assistant Examiner*—Kimnhung Nguyen

*Attorney, Agent, or Firm*—Ostrolenk, Faber, Gerb & Soffen, LLP

[57] ABSTRACT

A chip antenna comprising a substrate comprising at least one material selected from a dielectric material and a magnetic material, at least one conductor formed at least one of in the interior of the substrate and on the surface of the substrate, at least one feeding terminal provided on the surface of the substrate and connected to an end of the conductor for applying a voltage to the conductor, and at least one capacitor-forming conductor provided at least one of in the interior of the substrate and on the surface of the substrate and connected to the other end of the conductor. An antenna device comprising an antenna main body and a mounting board for mounting the antenna main body is also disclosed. The antenna main body may have the same configuration as the above-described chip antenna.

28 Claims, 6 Drawing Sheets

CHIP ANTENNA AND ANTENNA DEVICE

BACKGROUND OF THE INVENTION

1. Field of the Invention

The present invention relates to chip antennas and antenna devices. In particular, the present invention relates to a chip antenna and an antenna device used in mobile communication and mobile communication devices for local area networks (LAN).

2. Description of the Related Art

FIG. 12(*a*) is a plan view of a conventional chip antenna and FIG. 12(*b*) is a cross-sectional view taken along section line A—A of FIG. 12(*b*). This chip antenna 1 is of a microstrip type and is provided with a radiation electrode 3 as an antenna element on a main surface of a planar dielectric substrate 2 and a ground electrode 4 on the other main surface of the substrate 2. The dielectric substrate 2 is a planar rectangular member comprising a dielectric ceramic material such as aluminum or a polymeric compound. The radiation electrode 3 is smaller than the dielectric substrate 2, whereas the ground electrode 4 is formed on the entire main surface of the dielectric substrate 2. The ground electrode 4 is connected to an external conductor 6 of a coaxial cable 5 and the radiation electrode 3 is connected to a central conductor 7 at the feeding point 8.

The resonance frequency f and the bandwidth BW of the chip antenna 1 are determined by the following equations in response to the shape of the antenna:

$$f=Co/2\times(e)^{1/2}\times l \quad (1)$$

$$BW=(K\times d\times f)/\epsilon \quad (2)$$

wherein Co is the velocity of light, $\epsilon$ is the relative dielectric constant of the dielectric substrate 2, l is a vertical length of the radiation electrode 3 as the antenna element, K is a constant of proportionality, and d is the thickness of the dielectric substrate 2 shown in FIG. 12(*b*).

When the resonance frequency f is constant, use of a material having a large relative dielectric constant as the dielectric substrate 2 is capable of reducing the vertical length l of the radiation electrode 3, thus miniaturizing the chip antenna 1.

When the resonance frequency, however, is constant in the above-mentioned conventional antenna, a miniaturized antenna having a large relative dielectric constant has a narrow bandwidth and is not suitable for mobile communication devices which requires a broad bandwidth. Miniaturization of the antenna is therefore barely compatible with a broad bandwidth.

SUMMARY OF THE INVENTION

It is an object of the present invention to provide a compact chip antenna and an antenna device which have a broad bandwidth.

In accordance with the present invention, a chip antenna comprises a substrate comprising at least one material selected from a dielectric material and a magnetic materials, at least one conductor formed at least one of in an interior portion of the substrate and on a surface of the substrate, at least one feeding terminal provided on the surface of the substrate and connected to a first end of the conductor for applying a voltage to the conductor, and at least one capacitor-forming conductor provided in at least one position of the interior and the surface of the substrate and connected to a second end of the conductor.

In accordance with another aspect of the present invention an antenna device comprises an antenna main body and a mounting board for mounting the antenna main body; the antenna main body comprising a substrate comprising at least one material selected from a dielectric material and a magnetic material, at least one conductor formed at least one of in an interior portion of the substrate and on a surface of the substrate, at least one feeding terminal provided on the surface of the substrate and connected to a first end of the conductor for applying a voltage to the conductor, and at least one free terminal provided on the surface of the substrate and connected to a second end of the conductor; wherein at least one capacitor-forming conductor, which is connected to the free terminal of the antenna main body, is provided at least one of in an interior portion of the mounting board and a surface of the mounting board.

The above-mentioned capacitor-forming conductor comprises at least one conductive pattern of linear, network and planar patterns.

Since a chip antenna or an antenna device in accordance with the present invention is provided with a capacitor-forming conductor, a capacitance in response to the shape of the capacitor-forming conductor can be formed in a capacitor between the chip antenna or antenna device and the ground of a mobile communication device provided with the chip antenna or antenna device.

Other features and advantages of the present invention will become apparent from the following description of the invention which refers to the accompanying drawings.

DETAILED DESCRIPTION OF EMBODIMENTS OF THE INVENTION

Embodiments in accordance with the present invention will now be described with reference to the drawings.

Figure 1:
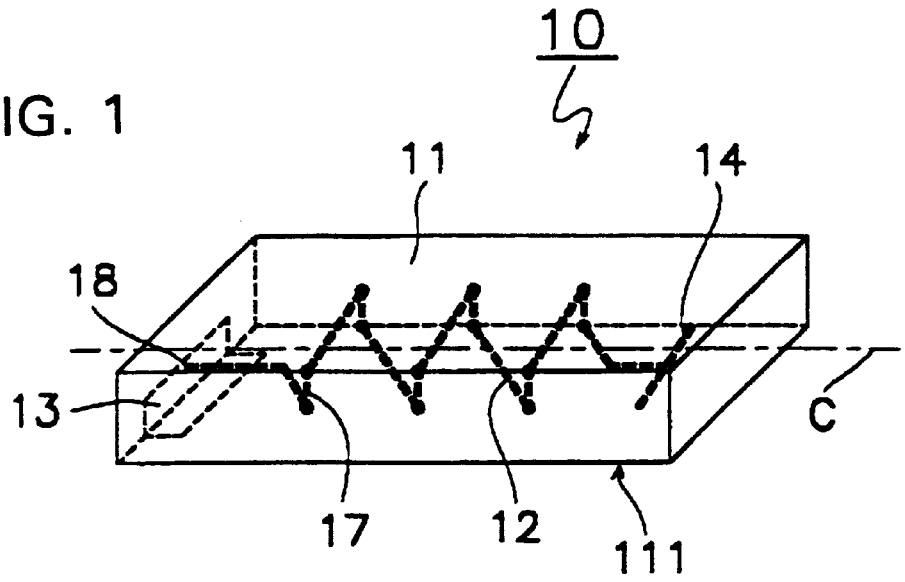
FIG. 1 is a perspective view illustrating a first embodiment of a chip antenna in accordance with the present invention.
Figure 2:
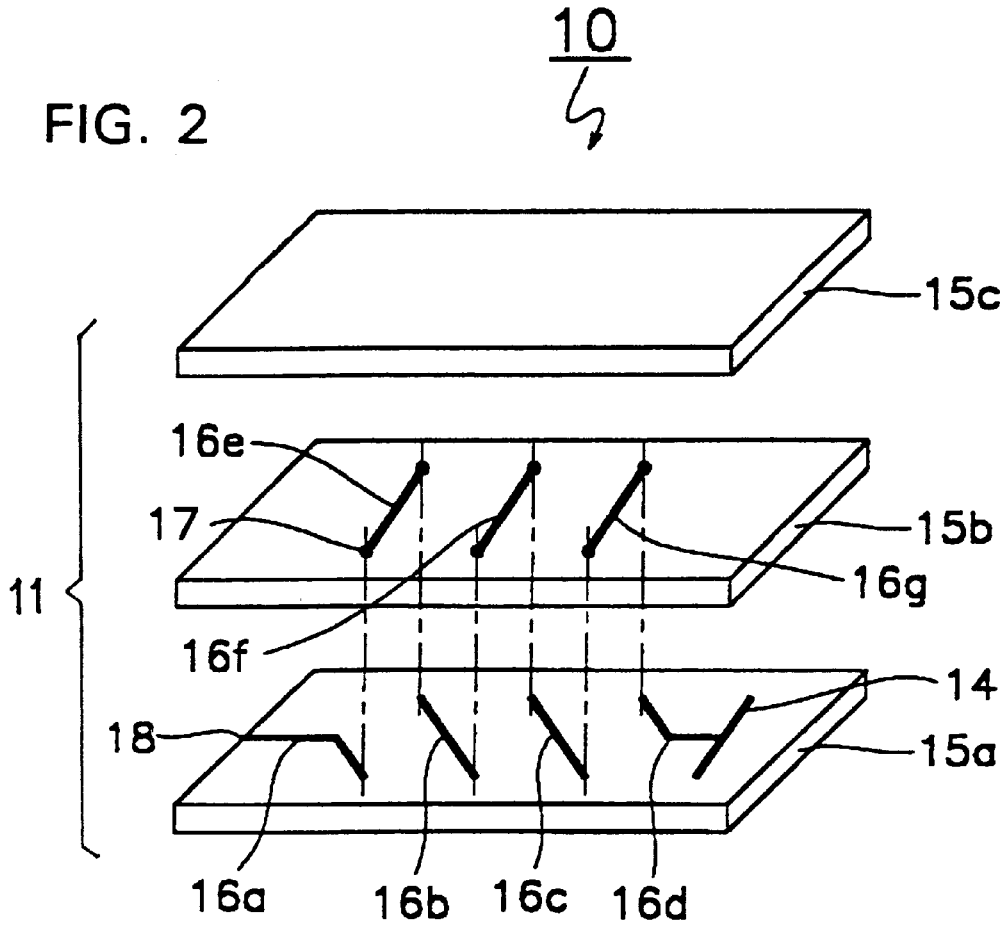
FIG. 2 is an exploded isometric view of the chip antenna in FIG. 1.

FIG. 1 is a perspective view illustrating a first embodiment of a chip antenna in accordance with the present invention, and FIG. 2 is an exploded isometric view of the chip antenna. The chip antenna 10 comprises a rectangular parallelopiped substrate 11 having a mounting surface 111, a spiral conductor 12 which is provided in the substrate 11 and has a spiral axis C parallel to the mounting surface 111, i.e., along the longitudinal direction of the substrate 11, a feeding terminal 13 formed on the surface of the substrate 11 and connected to one end of the conductor 12 for feeding a voltage to the conductor 12, and a linear capacitor-forming conductor 14 connected to the other end of the conductor 12. A capacitor is formed between the capacitor-forming conductor 14 and the ground (not shown in the drawing) of a mobile communication device, such as a ground of a circuit mounting board on which the chip antenna 10 is mounted, provided with the chip antenna 10.

The substrate 11 may be a laminate of rectangular sheet layers 15*a* to 15*c* comprising a dielectric material having a relative dielectric constant of approximately 6.1 and containing barium oxide, aluminum oxide and silica as major components. Linear and/or bent conductive patterns 16*a* to 16*g* comprising copper or a copper alloy are formed on the surfaces of the sheet layers 15*a* and 15*b* by printing, evaporation, bonding, or plating. The linear capacitor-forming conductor 14 is formed on the surface of the sheet layer 15*a* by printing, evaporation, bonding or plating. Via holes 17 are formed at given positions in the sheet layer 15*b*, corresponding to both ends of the conductive patterns 16*e* to 16*g*, in the vertical direction.

The sheet layers 15*a* to 15*c* are laminated and baked, and the conductive patterns 16*a* to 16*g* are connected to each other through the via holes 17 to form the spiral conductor 12 having a rectangular cross-section along the longitudinal direction of the substrate 11. The linear capacitor-forming conductor 14 is formed inside the substrate 11.

One end of the conductor 12, i.e., one end of the conductive pattern 16*a*, extends to the surface of the substrate 11 to form a feeding section 18 which is connected to the feeding terminal 13 formed on the surface of the substrate 11 for applying a voltage to the conductor 12. The other end of the conductor 12, i.e., the other end of the conductive pattern 16*d*, is connected to the capacitor-forming conductor 14 inside the substrate 11.

Figure 3:
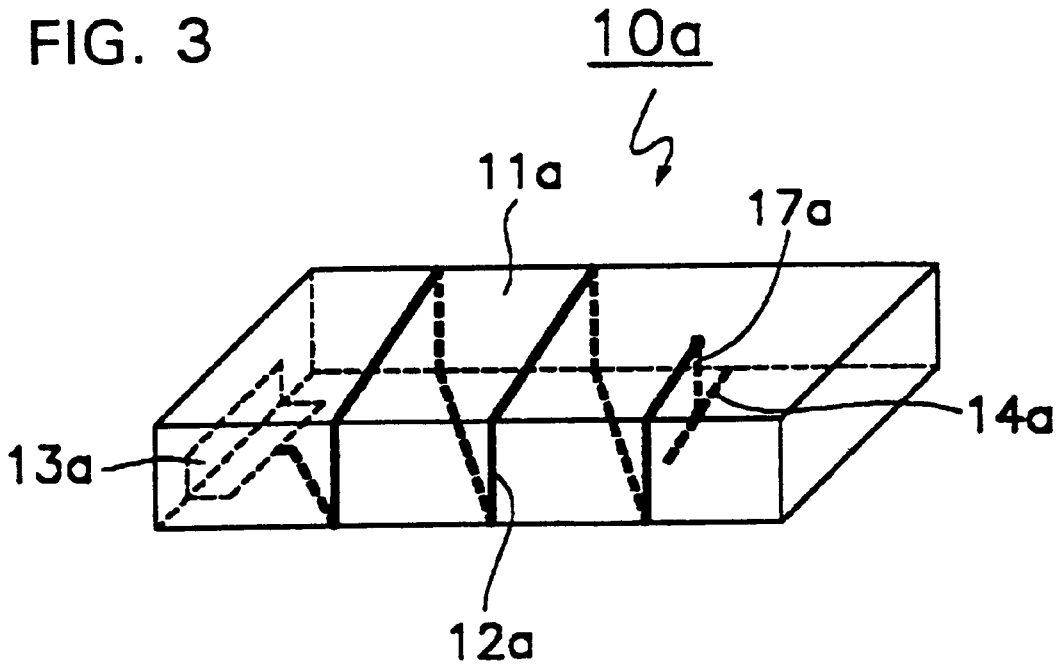
FIG. 3 is a perspective view illustrating a modification of the chip antenna in FIG. 1.
Figure 4:
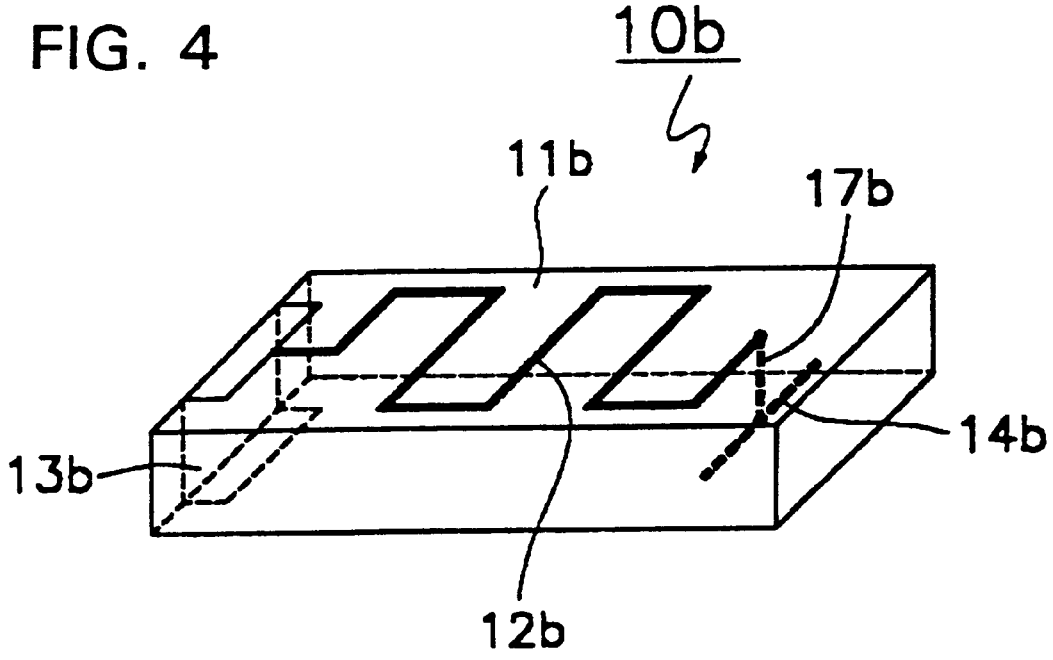
FIG. 4 is a perspective view illustrating another modification of the chip antenna in FIG. 1.

FIGS. 3 and 4 are perspective views of modifications of the chip antenna shown in FIG. 1. A chip antenna 10*a* shown in FIG. 3 is provided with a rectangular parallelopiped substrate 11*a*, a spiral conductor 12*a* wound around the surfaces of the substrate 11*a* in the longitudinal direction of the substrate 11*a*, a feeding terminal 13*a* formed on a substrate 11*a* and connected to one end of the conductor 12*a* for feeding a voltage to the conductor 12*a*, and a linear capacitor-forming conductor 14*a* formed inside the substrate 11*a* and connected to the other end of the conductor 12*a* through a via hole 17*a*. A capacitor is formed between the capacitor-forming conductor 14*a* and the ground (not shown in the drawing) of a mobile communication device provided with the chip antenna 10*a*. In this embodiment, the spiral conductor can be readily formed on the surfaces of the substrate by screen printing, and thus the chip antenna can be produced by simplified production processes.

A chip antenna 10*b* shown in FIG. 4 comprises a rectangular parallelopiped substrate 11*b*, a meandering conductor 12*b* formed on a surface (one of the main surfaces) of the substrate 11*b*, a feeding terminal 13*b* formed on the surface of the substrate 11*b* and connected to one end of the conductor 12*b* for feeding a voltage to the conductor 12*b*, and a linear capacitor-forming conductor 14*b* formed on the surface of the substrate 11*b* and connected to the other end of the conductor 12*b* through a via hole 17*b*. A capacitor is formed between the capacitor-forming conductor 14*b* and the ground (not shown in the drawing) of a mobile communication device provided with the chip antenna 10*b*. In this embodiment, since the meandering conductor is formed on only one main surface, a thickness reduction of the substrate, and thus a thickness reduction of the antenna itself can be achieved. The meandering conductor may also be provided inside the substrate.

Figure 5:
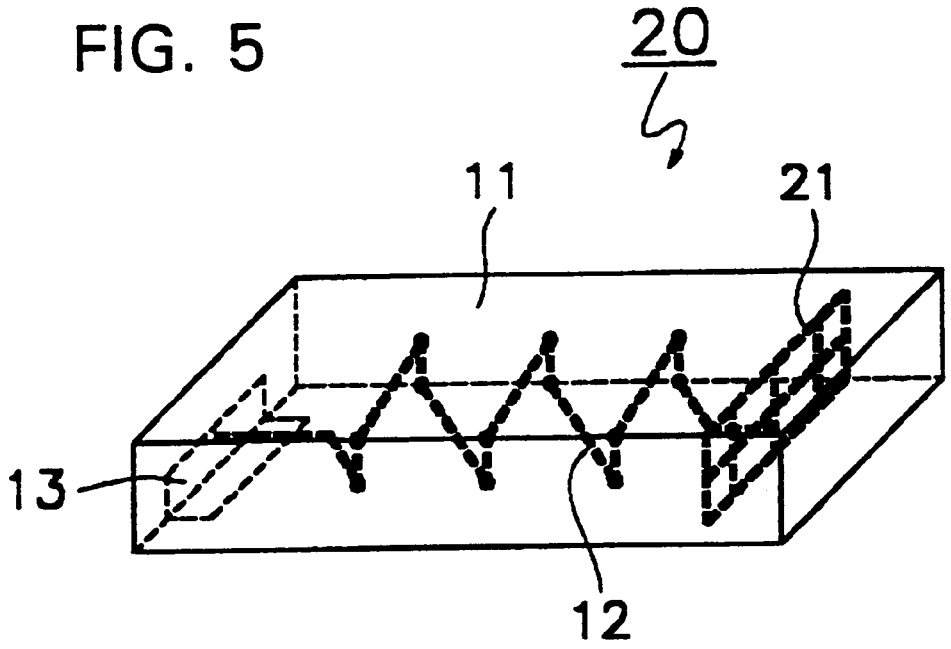
FIG. 5 is a perspective view illustrating a second embodiment of a chip antenna in accordance with the present invention.

FIG. 5 is a perspective view of a second embodiment of a chip antenna in accordance with the present invention. The chip antenna 20 has a rectangular network capacitor-forming conductor which is different from the linear capacitor-forming conductor in the chip antenna 10. The chip antenna 20 comprises a rectangular parallelopiped substrate 11, a spiral conductor 12 wound inside the substrate 11 along the longitudinal direction, a feeding terminal 13 formed on the surface of the substrate 11 and connected to one end of the conductor 12 for applying a voltage to the conductor 12, and a rectangular network capacitor-forming conductor 21 formed inside the substrate 11 and connected to the other end of the conductor 12. A capacitor is formed between the capacitor-forming conductor 21 and the ground (not shown in the drawing) of a mobile communication device provided with the chip antenna 20. The rectangular network capacitor-forming conductor 21 can be formed by, for example, connecting linear conductive patterns, which are formed on a plurality of sheet layers, through via holes.

Figure 6:
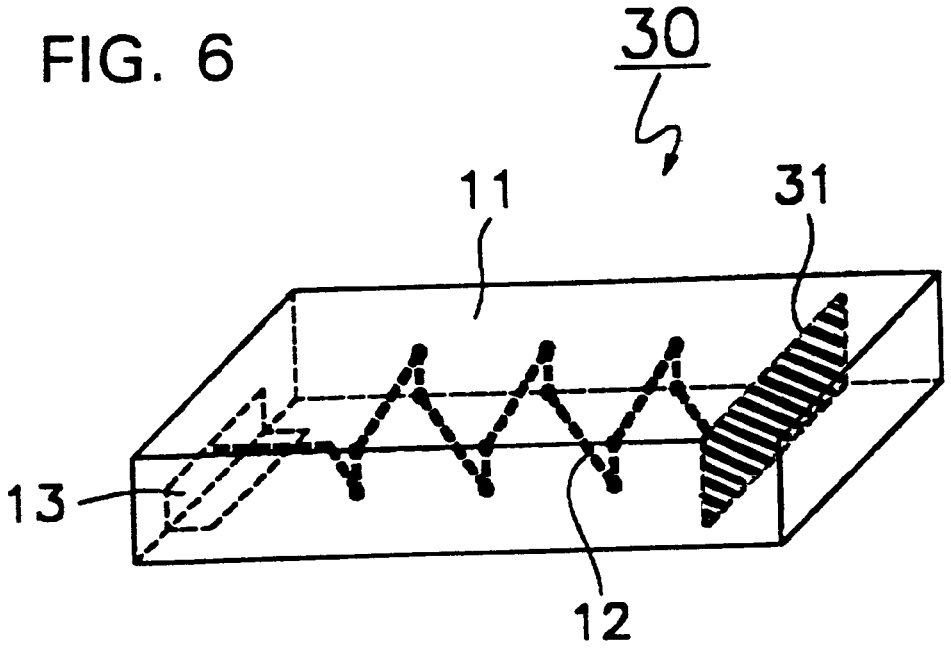
FIG. 6 is a perspective view illustrating a third embodiment of a chip antenna in accordance with the present invention.

FIG. 6 is a perspective view of a third embodiment of a chip antenna in accordance with the present invention. The chip antenna 30 has a rectangular planar capacitor-forming conductor which is different from the linear capacitor-forming conductor in the chip antenna 10. The chip antenna 30 comprises a rectangular parallelopiped substrate 11, a spiral conductor 12 wound inside the substrate 11 along the longitudinal direction, a feeding terminal 13 formed on the surface of the substrate 11 and connected to one end of the conductor 12 for applying a voltage to the conductor 12, and a rectangular planar capacitor-forming conductor 31 formed inside the substrate 11 and connected to the other end of the conductor 12. A capacitor is formed between the capacitor-forming conductor 31 and the ground (not shown in the drawing) of a mobile communication device provided with the chip antenna 30. The rectangular planar capacitor-forming conductor 31 can be formed, for example, by laminating a plurality of sheet layers each having openings filled with a conductive paste.

Figure 12A:
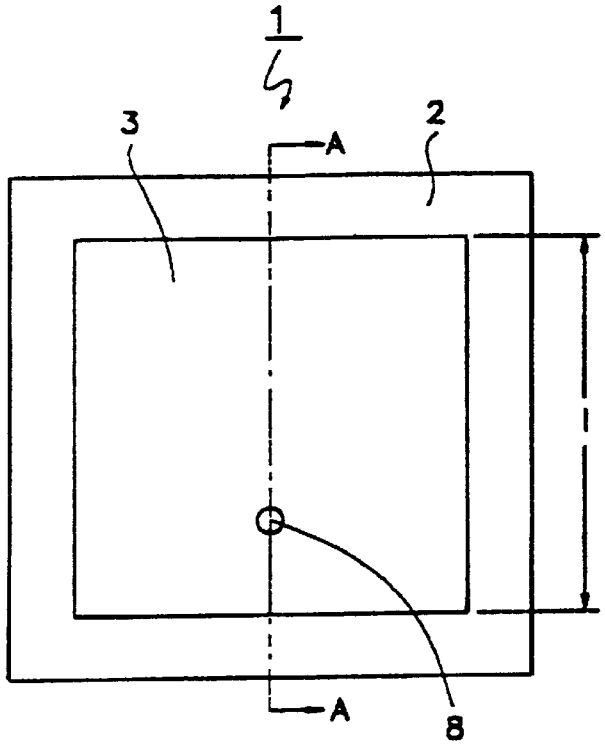
FIG. 12(a) PRIOR ART
FIGS. 12(*a*) and 12(*b*) are, respectively, a plan view of a conventional chip antenna and a cross-sectional view taken along section line A—A of FIG. 12(*a*).
Figure 12B:
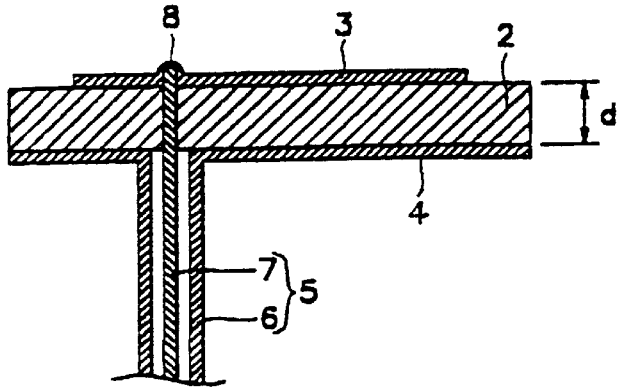
FIG. 12(b) PRIOR ART

Table 1 shows resonance frequencies f (GHz) and bandwidths BW (MHz) which were observed for the chip antennas 10, 20 and 30, as well as the conventional chip antenna 1 shown in FIG. 12 for comparison. These chip antennas 10, 20, 30 and 1 have an outer size of 6.3 mm by 5 mm by 2.5 mm. The relative dielectric constant of the dielectric material used in the substrates is approximately 6.1.

TABLE 1

| | f (GHz) | BW (MHz) |
|---|---|---|
| Chip antenna 10 (linear) | 1.91 | 79 |
| Chip antenna 20 (network) | 1.86 | 91 |
| Chip antenna 30 (planar) | 1.87 | 100 |
| Chip antenna 1 (conventional) | 1.92 | 35 |

The results in Table 1 demonstrate that the chip antennas 10, 20 and 30 in accordance with the present invention have bandwidths greater than twice that of the conventional chip antenna 1 at frequency resonances of approximately 1.9 GHz. The results also demonstrate that the bandwidth increases as the area of the capacitor-forming conductor increases, and thus the capacitance formed between the capacitor-forming conductor and the ground of a mobile communication device increases, because the planar capacitor-forming conductor has a maximum bandwidth, and the network capacitor-forming conductor has a broader bandwidth compared to the linear capacitor-forming conductor.

Since it is considered that the chip antennas 10, 20 and 30 cause series resonance of the inductance of the conductor with the capacitor formed between the capacitor-forming conductor and the ground, the resonance frequency f and the bandwidth BW are determined by the following equations:

$$f=1/(2p\times(L\times C)^{1/2}) \quad (3)$$

$$BW=k\times(C/L)^{1/2} \quad (4)$$

wherein L is the inductance of the conductor, C is the capacitance of the capacitor formed between the capacitor-forming conductor and the ground, and k is a constant of proportionality.

When the capacitance C between the capacitor-forming conductor and the ground increases, the inductance L of the conductor must be reduced at a constant frequency resonance F as deduced from the equation (3). A chip antenna having a broad bandwidth can therefore be achieved by increasing the capacitance C formed between the capacitor-forming conductor and the ground and by decreasing the inductance L of the conductor as deduced from the equation (4).

According to the structures of the chip antennas in the first to third embodiments, the capacitance formed between the capacitor-forming conductor and the ground of a mobile communication device provided with the chip antenna is capable of achieving compact chip antennas having broad bandwidths.

Miniaturization of chip antennas is capable of achieving miniaturized mobile communication devices, such as pagers, personal handyphone systems (PHSs), and specified low power radio communication systems.

The network capacitor-forming conductor having an increased area in the chip antenna shown in the second embodiment can increase the capacitance formed between the capacitor-forming conductor and the ground of a mobile communication device provided with the chip antenna. The chip antenna in the second embodiment therefore has a bandwidth which is approximately 15% broader than that in the first embodiment. Thus, mobile communication devices having broader bandwidths can be achieved.

The planar capacitor-forming conductor having a further increased area in the chip antenna shown in the third embodiment can further increase the capacitance formed between the capacitor-forming conductor and the ground of a mobile communication device provided with the chip antenna. The chip antenna in the third embodiment therefore has a bandwidth which is approximately 27% broader than that in the first embodiment. Thus, mobile communication devices having broader bandwidths can be achieved.

Figure 7:
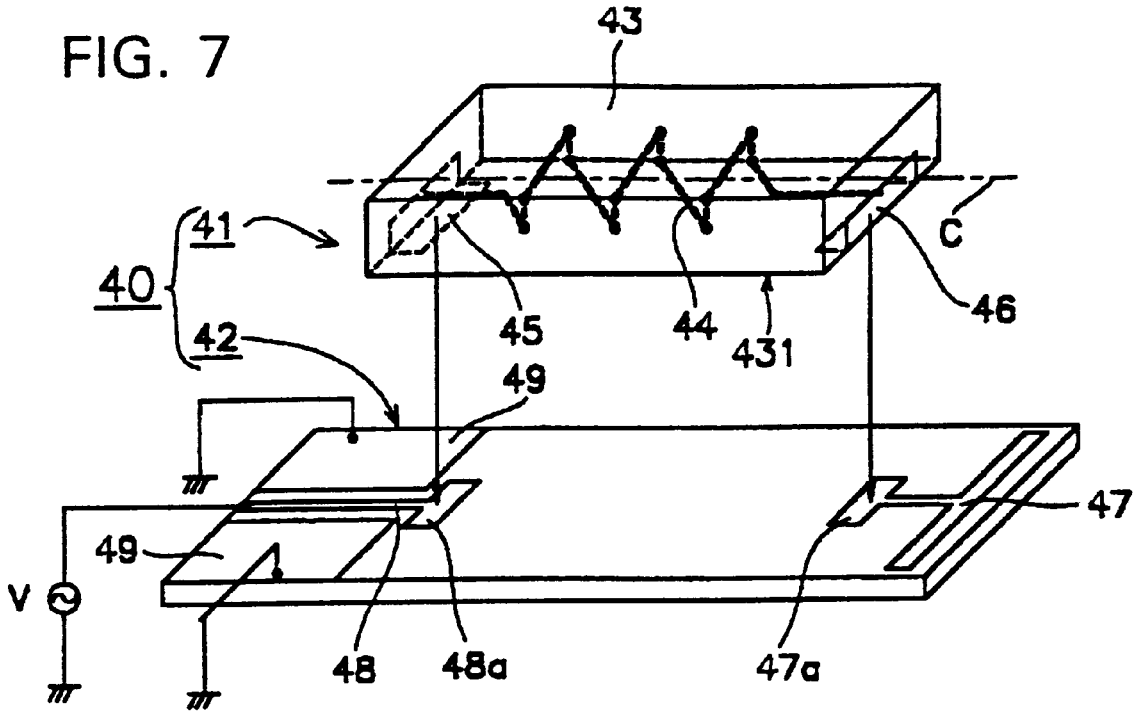
FIG. 7 is an isometric view of a first embodiment of an antenna device in accordance with the present invention, including a perspective view of an antenna main body of the antenna device.

FIG. 7 is an isometric view of a first embodiment of an antenna device in accordance with the present invention, including a perspective view of an antenna main body of the antenna device. The antenna device 40 comprises an antenna main body 41 and a mounting board 42 for mounting the antenna main body 41.

The antenna main body 41 is preferably made of a dielectric material comprising barium oxide, aluminum oxide and silica and having a relative dielectric constant of approximately 6.1, and comprises a rectangular parallelopiped substrate 43 having a mounting surface 431, a spiral conductor 44, which preferably comprises copper or a copper alloy, wound inside the substrate 43 and having a wound axis C parallel to the mounting surface 431, i.e., along the longitudinal direction of the substrate 43, a feeding terminal 45 formed on the surface of the substrate 43 and connected to one end of the conductor 44 for applying a voltage to the conductor 44, and a free terminal 46 formed on the substrate 43 and connected to the other end of the conductor 44.

The mounting board 42 may be formed of a plastic plate or the like and is provided with a linear capacitor-forming conductor 47 thereon having a land 47*a* connected to the free terminal 46 of the antenna main body 41, a transmission line 48 having a land 48*a* connected to the feeding terminal 45 of the antenna main body 41 at one end and a power unit V at the other end for applying a voltage to the antenna main body 41, and a ground electrode 49. The linear capacitor-forming conductor 47 is formed by printing, evaporation, bonding or plating.

In such a configuration, a capacitor is formed between the capacitor-forming conductor 47 and the ground of a mobile communication device provided with the antenna 40, for example, the ground electrode 49 of the mounting board 42.

Figure 8:
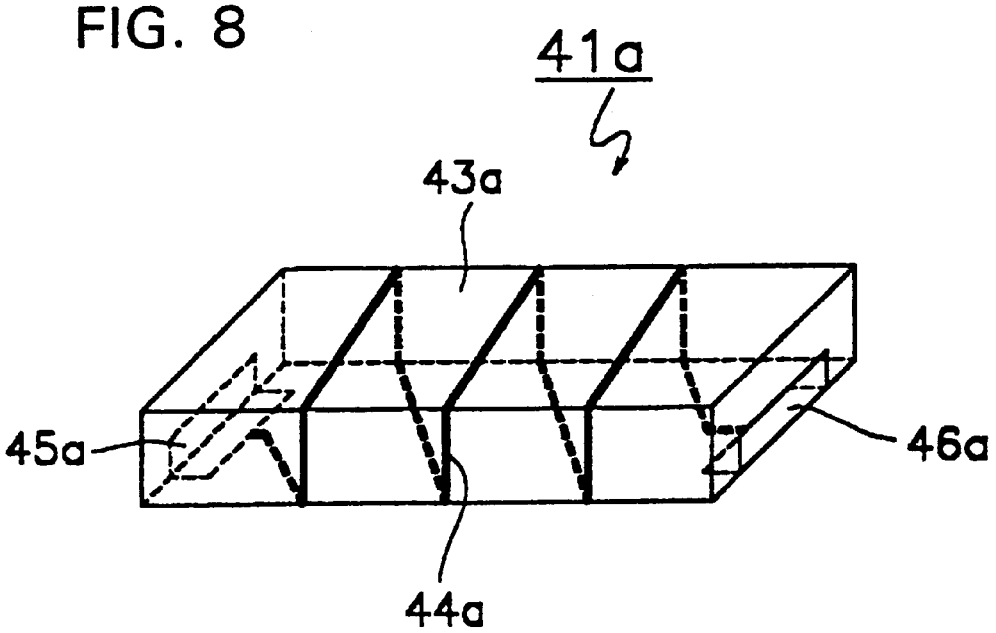
FIG. 8 is a perspective view of a modification of the antenna main body in FIG. 7.
Figure 9:
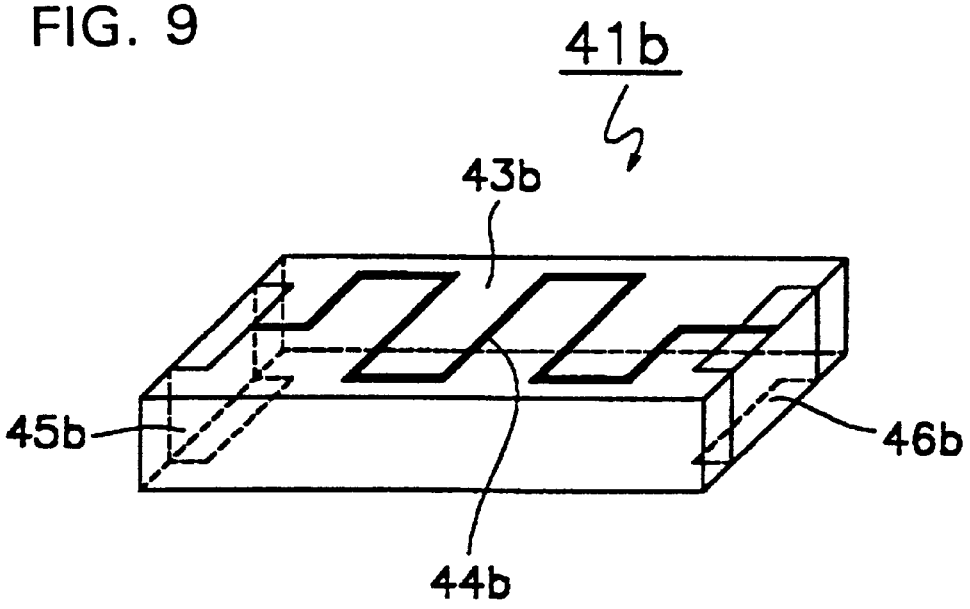
FIG. 9 is a perspective view of another modification of the antenna main body in FIG. 7.

FIGS. 8 and 9 are perspective views of modifications of the antenna main body shown in FIG. 7. The antenna main body 41*a* shown in FIG. 8 comprises a rectangular parallelopiped substrate 43*a*, a spiral conductor 44*a* wound around the surfaces of the substrate 43*a* in the longitudinal direction of the substrate 43*a*, a feeding terminal 45*a* formed on a surface of the substrate 43*a* and connected to one end of the conductor 44*a* for applying a voltage to the conductor 44*a*, and a free terminal 46*a* formed on the surface of the substrate 43*a* and connected to the other end of the conductor 44*a*. The feeding terminal 45*a* is connected to the land 48*a* of the transmission line 48 on the mounting board 42 shown in FIG. 7, and the free terminal 46*a* is connected to the land 47*a* of the capacitor-forming conductor 47 on the mounting board 42. In this case, since the spiral conductor can be simply formed on the surfaces of the substrate by screen printing or the like, the antenna main body can also be produced by a simplified process.

The antenna main body 41*b* shown in FIG. 9 comprises a rectangular parallelopiped substrate 43*b*, a meandering conductor 44*b* formed on a surface of the substrate 43*b*, a feeding terminal 45*b* formed on the surface of the substrate 43*b* and connected to one end of the conductor 44*b* for feeding a voltage to the conductor 44*b*, and a free terminal 46*b* formed on the surface of the substrate 43*b* and connected to the other end of the conductor 44*b*. The feeding terminal 45*b* is connected to the land 48*a* of the transmission line 48 on the mounting board 42 shown, and the free terminal 46*b* is connected to the land 47*a* of the capacitor-forming conductor 47 on the mounting board 42. In this case, since the meandering conductor is formed on only one main surface, the thickness reduction of the substrate, and thus the thickness reduction of the antenna itself can be achieved. The meandering conductor may also be provided inside the substrate.

Figure 10:
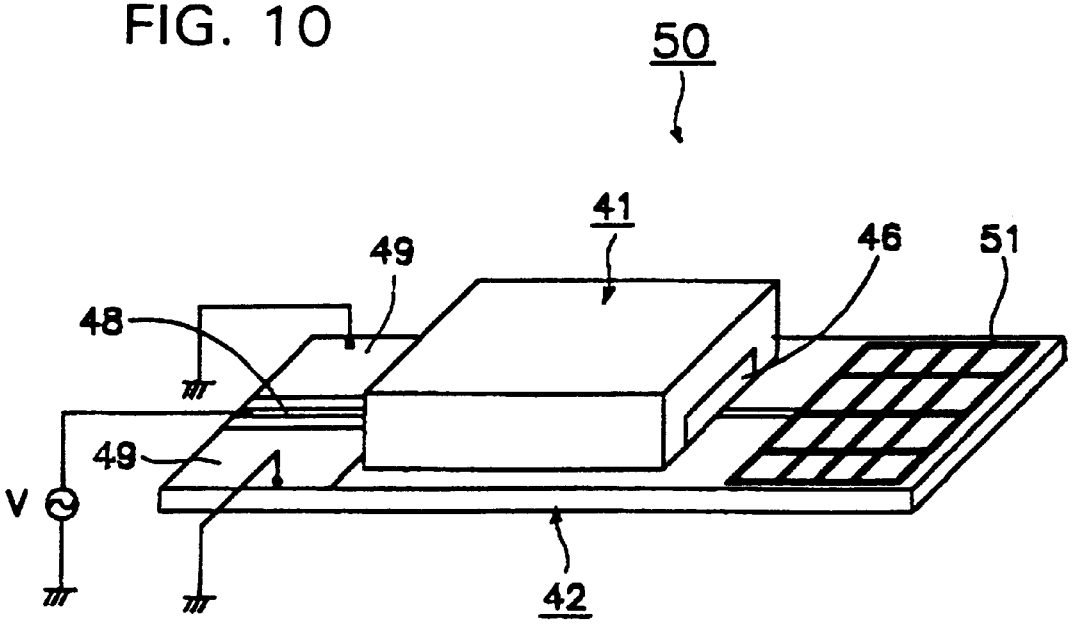
FIG. 10 is a perspective view of a second embodiment of an antenna device in accordance with the present invention.

FIG. 10 is an isometric view of a second embodiment of an antenna device in accordance with the present invention.

The antenna device 50 is provided with a rectangular network capacitor-forming conductor on the mounting board instead of the linear capacitor-forming conductor in the first embodiment. The antenna device 50 comprises an antenna main body 41, a mounting board 42 for mounting the antenna main body 41, and a rectangular network capacitor-forming conductor 51 provided with a land (not shown in the drawing) which is connected to the free terminal 46 of the antenna main body 41 formed on the mounting board 42. In such a configuration, a capacitor is formed between the capacitor-forming conductor 51 and the ground of a mobile communication device provided with the antenna device 50, for example, the ground electrode 49 of the mounting board 42. The rectangular network capacitor-forming conductor 51 is formed by printing, evaporation, bonding or plating.

Figure 11:
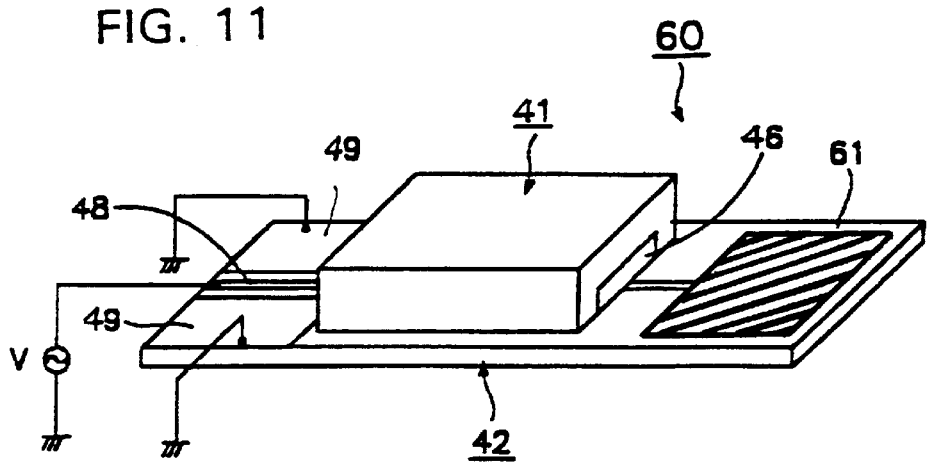
FIG. 11 is a perspective view of a third embodiment of an antenna device in accordance with the present invention.

FIG. 11 is an isometric view of a third embodiment of an antenna device in accordance with the present invention. The antenna device 60 is provided with a rectangular planar capacitor-forming conductor on the mounting board instead of the linear capacitor-forming conductor in the first embodiment. The antenna device 60 comprises an antenna main body 41 and a mounting board 42 for mounting the antenna main body 41, and the rectangular planar capacitor-forming conductor 61 provided with a land (not shown in the drawing), which is connected to the free terminal 46 of the antenna main body 41 formed on the mounting board 42. In such a configuration, a capacitor is formed between the capacitor-forming conductor 61 and the ground of a mobile communication device provided with the antenna device 60, for example, the ground electrode 49 of the mounting board 42. The rectangular planar capacitor-forming conductor 61 is formed by printing, evaporation, bonding or plating.

According to the configurations shown in the first to third embodiments, a compact antenna device having a broad bandwidth can be achieved as in the above-mentioned chip antennas by forming a capacitor between the capacitor-forming conductor and the ground of a mobile communication device provided with the antenna device.

Miniaturization of antenna devices is capable of achieving miniaturized mobile communication devices, such as pagers, personal handyphone systems (PHSs), and specified low power radio communication systems.

The network capacitor-forming conductor having an increased area in the antenna device shown in the second embodiment can increase the capacitance formed between the capacitor-forming conductor and the ground of a mobile communication device provided with the antenna device. The antenna device in the second embodiment therefore has a bandwidth broader than that in the first embodiment. Thus, mobile communication devices having broader bandwidths can be achieved.

The planar capacitor-forming conductor having a further increased area in the antenna device shown in the third embodiment can further increase the capacitance formed between the capacitor-forming conductor and the ground of a mobile communication device provided with the antenna device. The antenna device in the third embodiment therefore has a bandwidth broader than that in the first embodiment. Thus, mobile communication devices having broader bandwidths can be achieved.

The substrates of the above-mentioned chip antennas and antenna devices may be made of a dielectric material comprising barium oxide, aluminum oxide and silica as major components. The substrate, however, is not limited to this dielectric material, and may be made of a dielectric material comprising titanium oxide and neodymium oxide as major components, a magnetic material comprising nickel, cobalt and iron as major components, or a combination of a dielectric material and a magnetic material.

Each of the chip antennas and the antenna main bodies has one conductor in the above-mentioned embodiments. A chip antenna or antenna main body may be provided with a plurality of conductors disposed parallel to each other. The chip antenna or antenna main body has a plurality of resonance frequencies in response to the number of the conductors, and can act as a multiband antenna.

A linear capacitor-forming conductor is described above. Curved, meandering or serrate capacitor-forming conductors can also be used. The network or planar capacitor-forming conductor may have a circular, elliptical or polygonal shape instead of the rectangular shape described above.

The capacitor-forming conductors in the above-mentioned chip antennas are provided inside the substrate. The capacitor-forming conductor may be provided on the surface of the substrate.

The capacitor-forming conductors in the above-mentioned antenna devices are provided on the mounting board. The capacitor-forming conductor may be provided inside the mounting board.

Although the conductor is provided inside or on the substrate in the above-mentioned embodiments, a spiral or meandering conductor may be formed both on and inside the substrate.

According to the present invention, a compact chip antenna and antenna device having a broad bandwidth can be achieved by forming a capacitor between the capacitor-forming conductor and the ground of a mobile communication device provided with the chip antenna or antenna device.

Miniaturization of the chip antenna or antenna device is capable of achieving miniaturized mobile communication devices, such as pagers, personal handyphone systems (PHSs), and specified low power radio communication systems.

Although the present invention has been described in relation to particular embodiments thereof, many other variations and modifications and other uses will become apparent to those skilled in the art. Therefore, the present invention should be limited not by the specific disclosure herein, but only by the appended claims.

What is claimed is:

1. A chip antenna comprising a substrate comprising at least one material selected from a dielectric material and a magnetic material, at least one conductor formed at least one of in an interior portion of the substrate and on a surface of said substrate, at least one feeding terminal provided on the surface of said substrate and connected to a first end of said conductor for applying a voltage to said conductor, and at least one capacitor-forming conductor provided in the interior of said substrate and connected to a second end of said conductor, the substrate comprising a plurality of layers stacked on top of each other, the stacked layers establishing a direction of stacking the stacked layers normal to surfaces of the stacked layers, the conductor disposed spirally with respect to the substrate such that the conductor has a spiral axis extending perpendicular to the direction normal to the surfaces of the stacked layers.

2. The chip antenna of claim 1, wherein said capacitor-forming conductor comprises a conductive pattern comprising at least one of a linear pattern, network pattern and planar pattern.

3. The chip antenna of claim 1, wherein the conductor comprises a spiral shaped conductor.

4. The chip antenna of claim 1, wherein the conductor comprises a meandering conductor disposed essentially in a plane.

5. The chip antenna of claim 1, wherein the capacitor-forming conductor comprises a linear portion extending from the at least one conductor.

6. The chip antenna of claim 1, wherein the capacitor-forming conductor comprises a planar portion extending from and coupled to said at least one conductor.

7. The chip antenna of claim 1, wherein selected ones of the layers comprise at least one portion of the conductor, at least one layer comprising a conductive through hole connecting respective ones of the conductor portions together when the plurality of layers are laminated together, thereby forming the at least one conductor.

8. The chip antenna of claim 7, wherein the capacitor forming conductor comprises a plurality of conductive layers disposed on respective layers in contact with each other through a plurality of conductive through-holes when the layers are laminated together.

9. The chip antenna of claim 1, wherein the dielectric material comprises barium oxide, aluminum oxide and silica.

10. The chip antenna of claim 1, wherein the substrate comprises a dielectric material comprising titanium oxide and neodymium oxide.

11. The chip antenna of claim 1, wherein the substrate comprises a magnetic material comprising nickel, cobalt and iron.

12. The chip antenna of claim 1, wherein the substrate comprises a combination of a dielectric material and a magnetic material.

13. The chip antenna of claim 2, wherein the conductor is disposed spirally around the surface of the substrate.

14. The chip antenna of claim 4, wherein the meandering conductor is disposed on a surface of the substrate.

15. An antenna device comprising an antenna main body and a mounting board for mounting said antenna main body; said antenna main body comprising a substrate comprising at least one material selected from a dielectric material and a magnetic material, at least one conductor formed at least one of in an interior portion of the substrate and on a surface of said substrate, at least one feeding terminal provided on the surface of said substrate and connected to a first end of said conductor for applying a voltage to said conductor, and at least one free terminal provided on the surface of said substrate and connected to a second end of said conductor;

wherein at least one capacitor-forming conductor, which is connected to said free terminal of said antenna main body, is provided in an interior portion of the mounting board, the substrate comprising a plurality of layers stacked on top of each other, the stacked layers establishing a direction of stacking the stacked layers normal to surfaces of the stacked layers, the conductor disposed spirally with respect to the substrate such that the conductor has a spiral axis extending perpendicular to the direction normal to the surfaces of the stacked layers.

16. The antenna device of claim 15, wherein said capacitor-forming conductor comprises a conductive pattern comprising one of a linear pattern, network pattern and planar pattern.

17. The antenna device of claim 15, wherein the conductor comprises a spiral shaped conductor.

18. The antenna device of claim 15, wherein the conductor comprises a meandering conductor disposed essentially in a plane.

19. The antenna device of claim 15, wherein the capacitor-forming conductor comprises a linear portion extending from the at least one conductor.

20. The antenna device of claim 15, wherein the capacitor-forming conductor comprises a planar portion extending from and coupled to said at least one conductor.

21. The antenna device of claim 15, wherein selected ones of the layers comprise at least one portion of the conductor, at least one layer comprising a conductive through hole connecting respective ones of the conductor portions together when the plurality of layers are laminated together, thereby forming the at least one conductor.

22. The antenna device of claim 15, wherein the dielectric material comprises barium oxide, aluminum oxide and silica.

23. The antenna device of claim 15, wherein the substrate comprises a dielectric material comprising titanium oxide and neodymium oxide.

24. The antenna device of claim 15, wherein the substrate comprises a magnetic material comprising nickel, cobalt and iron.

25. The antenna device of claim 15, wherein the substrate comprises a combination of a dielectric material and a magnetic material.

26. The antenna device of claim 15, wherein the conductor is disposed spirally around the surface of the substrate.

27. The antenna device of claim 18, wherein the meandering conductor is disposed on a surface of the substrate.

28. The antenna device of claim 15, further comprising a ground conductor provided on said mounting board for providing a second capacitor-forming conductor forming a capacitor with the capacitor-forming conductor.

* * * * *